US009469505B2

(12) United States Patent
Piech et al.

(10) Patent No.: US 9,469,505 B2
(45) Date of Patent: Oct. 18, 2016

(54) SHEET METAL GUIDE RAIL FOR AN ELEVATOR SYSTEM

(75) Inventors: Zbigniew Piech, Cheshire, CT (US); Richard N. Fargo, Plainville, CT (US); Jamie A. Rivera, Bristol, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 643 days.

(21) Appl. No.: 13/699,197

(22) PCT Filed: May 21, 2010

(86) PCT No.: PCT/US2010/035742
§ 371 (c)(1),
(2), (4) Date: Nov. 20, 2012

(87) PCT Pub. No.: WO2011/146071
PCT Pub. Date: Nov. 24, 2011

(65) Prior Publication Data

US 2013/0062147 A1 Mar. 14, 2013

(51) Int. Cl.
*B66B 7/02* (2006.01)

(52) U.S. Cl.
CPC ..... *B66B 7/022* (2013.01)

(58) Field of Classification Search
CPC ..... B66B 7/022
USPC ..... 187/406; 104/124–127
See application file for complete search history.

(56) References Cited

U.S. PATENT DOCUMENTS 2,633,301 A * 3/1953 Esch ..... A63H 19/30 104/306
4,637,496 A * 1/1987 Atkey ..... B66B 7/022 187/408

(Continued)

FOREIGN PATENT DOCUMENTS

CN 101081674 A 12/2007
CN WO 2011116523 A1 * 9/2011 ..... B66B 7/022

(Continued)

OTHER PUBLICATIONS

Notification of Transmittal of the Internation Search Report and Written Opinion of the International Searching Authority; PCT/US2010/035742; Mailed Feb. 1, 2011; Korean Intellectual Property Office; 10 pages.

(Continued)

*Primary Examiner* — William A Rivera
*Assistant Examiner* — Stefan Kruer
(74) *Attorney, Agent, or Firm* — Cantor Colburn LLP

(57) ABSTRACT

A guide rail (14) for an elevator system (10) includes a base (20) connectable with a wall of a hoistway (12) of the elevator system (10) and a web section (24) connected to and extending from the base (20). A tip section (26) is located at an end of the web section (24) and is operably connectable to an elevator car (16) of the elevator system (10). The base (20), the web section (24) and the tip section (26) are formed of one or more thicknesses (28) of sheet metal material. An elevator system (10) includes an elevator car (16) located in a hoistway (12) and a guide rail (14) extending along the hoistway (12) and operably connected to the elevator car (16) for guiding the elevator car (16) along the hoistway (12). The guide rail (14) is configured such that braking forces applied to the guide rail (14) by a braking mechanism (36) successfully reduce the speed of the elevator car (16) without resulting in failure of the guide rail (14).

18 Claims, 7 Drawing Sheets

(56) References Cited

U.S. PATENT DOCUMENTS

| | | | | |
|---|---|---|---|---|
| 4,660,399 | A | 4/1987 | Suter et al. | |
| 5,518,087 | A | 5/1996 | Hwang et al. | |
| 5,950,770 | A * | 9/1999 | Koeppe, Jr. | B66B 7/022 187/406 |
| 2008/0011558 | A1* | 1/2008 | Lusquinos | 187/406 |
| 2008/0135345 | A1 | 6/2008 | Kocher et al. | |
| 2008/0296097 | A1 | 12/2008 | Syrman et al. | |
| 2015/0307320 | A1* | 10/2015 | Hubbard | B66B 7/022 187/359 |

FOREIGN PATENT DOCUMENTS

| | | | | |
|---|---|---|---|---|
| FR | 929867 | A * | 1/1948 | B66B 7/02 |
| JP | 55-092671 | U | 6/1980 | |
| JP | 57-19267 | | 2/1982 | |
| JP | 59-102778 | A | 6/1984 | |
| JP | 59-108684 | A | 6/1984 | |
| JP | 04129983 | A * | 4/1992 | B66B 7/02 |
| JP | 05124780 | A * | 5/1993 | B66B 7/02 |
| JP | 10087224 | A * | 4/1998 | B66B 7/02 |
| JP | 5561583 | B2 | 7/2014 | |
| KR | 1999-0017365 | U | 5/1999 | |
| KR | 1999-0017366 | U | 5/1999 | |
| SU | 12036 | A1 | 9/1929 | |
| WO | WO 2011146073 | A1 * | 11/2011 | B66B 5/26 |
| WO | WO 2012087295 | A1 * | 6/2012 | B66B 7/022 |

OTHER PUBLICATIONS

Japanese Office Action (English translation) for application JP 2013-511136, dated Oct. 24, 2014, 2 pages.

Russian Office Action (English translation) for application RU 2012146602/11(074834), dated Oct. 1, 2014, 4 pages.

Chinese Second Office Action for application 201080066892.5, dated Jan. 14, 2015, 6 pages.

* cited by examiner

SHEET METAL GUIDE RAIL FOR AN ELEVATOR SYSTEM

BACKGROUND OF THE INVENTION

The subject matter disclosed herein generally relates to elevator systems. More specifically, the subject disclosure relates to guide rails for elevator cars.

Elevator systems typically include an elevator car suspended in a hoistway by a number of suspension ropes. To guide the elevator car in the hoistway, a number of guide rails are arranged in the hoistway, for example, from the top to bottom of the hoistway. The elevator car is connected to the guide rails via one or more guide shoes such that the elevator car follows a path defined by the guide rails as it moves through the hoistway. Further, in some elevator systems, a braking mechanism connected to the elevator car acts on the guide rails to slow and/or stop the elevator car in the hoistway.

The typical guide rail is a solid steel T-shaped rail. Such rail configurations are typically utilized because of their ability to withstand buckling and deflection during normal elevator operations and to withstand and loads applied during emergency braking. The typical rails, however, are heavy and bulky, with each rail typically weighing 8 or more pounds per linear foot and are typically installed in 20-foot sections. Installation requires heavy equipment due to the weight of the rails, and is additionally difficult due to the constraints of installing the sections in the confined space of the elevator hoistway. The art would well receive a lighter weight, more easily installed guide rail which can withstand the operational and braking loads of the elevator system.

BRIEF DESCRIPTION OF THE INVENTION

According to one aspect of the invention, a guide rail for an elevator system includes a base connectable with a hoistway of the elevator system and a web section connected to and extending from the base. A tip section is located at an end of the web section and is operably connectable to an elevator car of the elevator system. The base, the web section and the tip section are formed of one or more thicknesses of sheet metal material. The guide rail is configured such that braking forces applied to the guide rail by a braking mechanism successfully reduce the speed of the elevator car without resulting in failure of the guide rail.

According to another aspect of the invention, an elevator system includes an elevator car located in a hoistway and a guide rail extending along the hoistway and operably connected to the elevator car for guiding the elevator car along the hoistway. The guide rail includes a base connectable with the hoistway, a web section connected to and extending from the base, and a tip section located at an end of the web section and operably connected to the elevator car. The base, the web section and the tip section are formed of one or more thicknesses of sheet metal material. The elevator system includes a braking mechanism operably connected to the guide rail and the elevator car, the guide rail configured such that braking forces applied by the braking mechanism to the guide rail successfully reduce a speed of the elevator car without resulting in failure of the guide rail.

These and other advantages and features will become more apparent from the following description taken in conjunction with the drawings.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
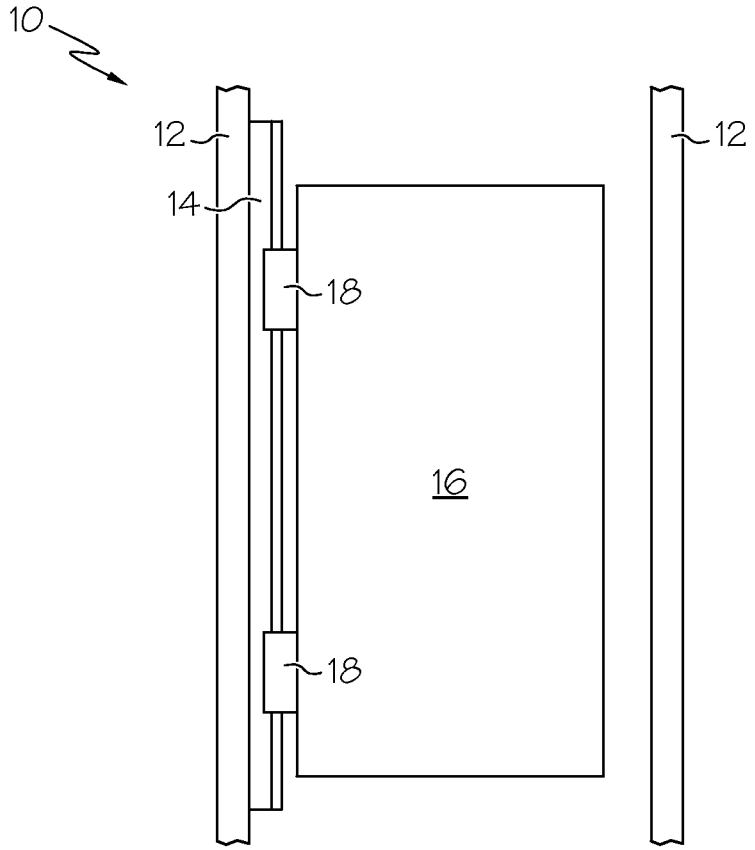
FIG. 1 is a schematic view of an embodiment of an elevator system.
Figure 2:
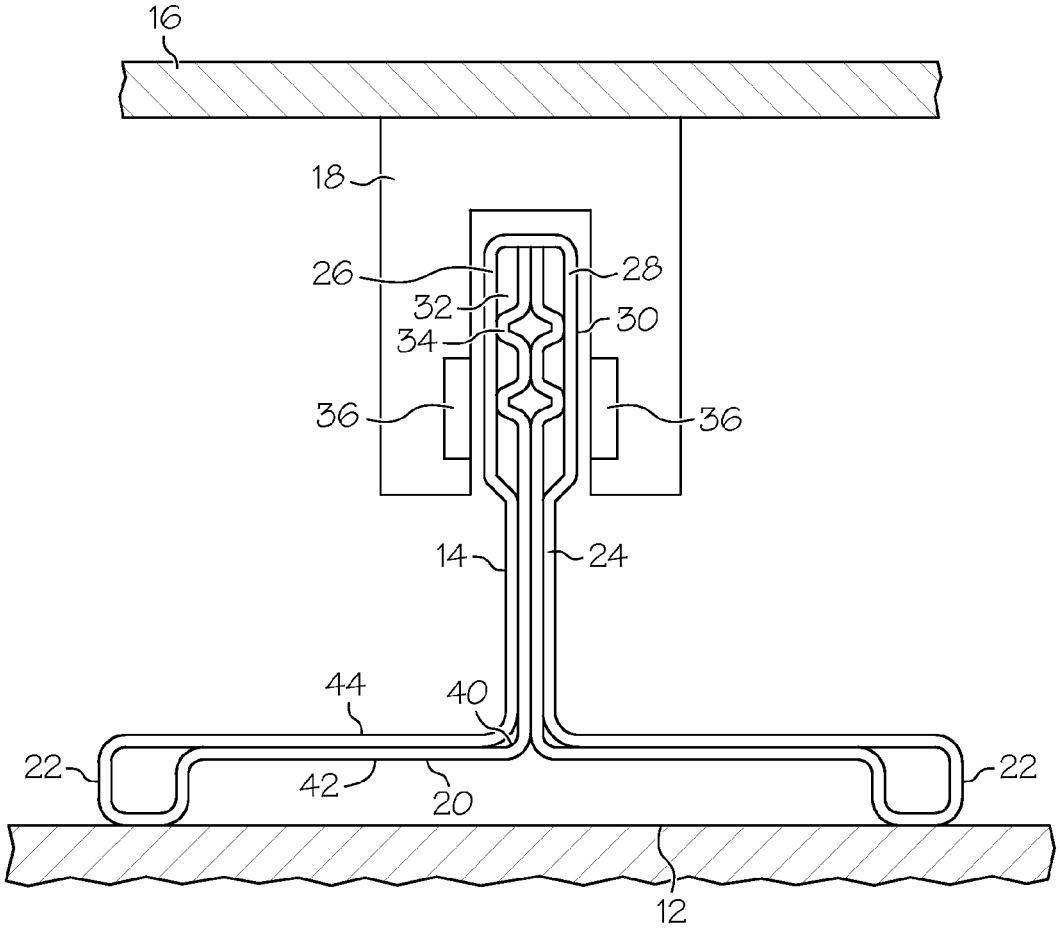
FIG. 2 is a cross-sectional view of an embodiment of a guide rail for an elevator system.

Shown in FIG. 1 is an embodiment of an elevator system 10. The elevator system 10 is located in a hoistway 12 and includes one or more guide rails 14 affixed to the hoistway 12. The guide rails 14 are connected to an elevator car 16 to guide the movement of the elevator car 16 through the hoistway 12. As shown in FIGS. 1 and 2, in some embodiments, the elevator car 16 includes at least one guide shoe 18 which interfaces with the guide rail 14.

Figure 3:
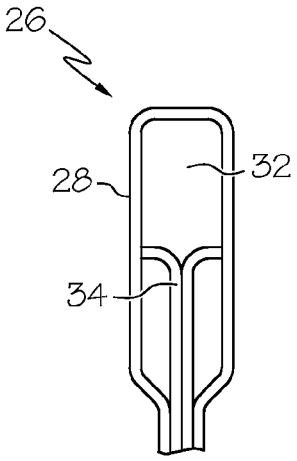
FIG. 3 is a cross-sectional view of a tip section of a guide rail for an elevator system.
Figure 4:
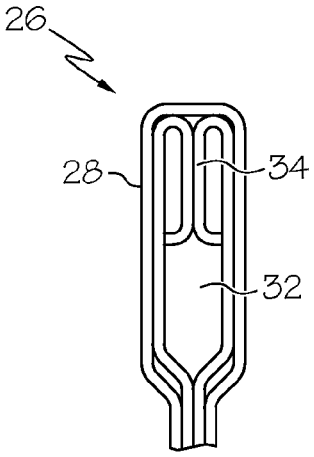
FIG. 4 is a cross-sectional view of another embodiment of a tip section of a guide rail for an elevator system.

An embodiment of a guide rail 14 is shown in FIG. 2. The cross-section is formed from a sheet metal, which may be bent, roll-formed, welded, and/or otherwise manipulated into the final shape. The guide rail 14 of FIG. 2 is formed from a single piece of sheet metal. In other embodiments, however, the guide rail 14 may be formed of two or more pieces of sheet metal formed into the guide rail 14. The guide rail 14 includes a base 20 having two base pads 22 configured to rest against the wall of the hoistway 12. A web 24 extends in one direction from the base 20 into the hoistway 12 toward the elevator car 16. To enhance stiffness of the guide rail 14, in a transition area between the base 20 and the web 24, there is a space 40 between an inner sheet 42 and an outer sheet 44 of material. Either or both of the base 20 and the web 24 comprise multiple layers of sheet metal material such that rail 14 has sufficient stiffness and rigidity sufficient to guide the elevator car 16. The web 24 extends to a tip section 26. The tip section 26, as shown in FIG. 2, may have the same dimensional shape as a typical steel guide rail. The tip section 26 includes one or more material thicknesses 28 to form an exterior portion 30 of the tip section and a tip cavity 32 inside the tip section 26. As shown in FIG. 2, the elevator car 16 has a guide shoe 18 including a safety brake 36. When a condition exists in which the elevator car 16 needs to be stopped, the safety brake 36 is actuated to engage guide rail 14 and stop the elevator car 16. More specifically, safety brake 36 applies braking forces to the exterior 30 of tip section 26, in order to stop the elevator car 16. One or more stiffeners 34 are located in the tip cavity 32 and span at least partially across the tip cavity 32 to stiffen the tip section 26 and allow it to withstand such braking forces. If the tip section 26 is not sufficiently stiff, when braking forces are applied, the tip section 26 could structurally fail, requiring replacement of the guide rail 14. In some embodiments, such as in FIG. 2, the stiffeners 34 may be baffle-shaped. In other embodiments, such as in FIG. 3, the stiffeners 34 may be ribs extending toward the sides 38 of the tip section 26, or as in FIG. 4, the stiffeners 34 may comprise loops of material disposed in the tip cavity 32. In other embodiments, a filler material may be inserted in the tip cavity 32 by injection or other means to add additional stiffness to the tip section. In addition to the exemplary embodiments shown and described herein, many other variations of tip section 26, with various configurations of stiffeners 34, also exist that are consistent with the present invention.

Figure 5:
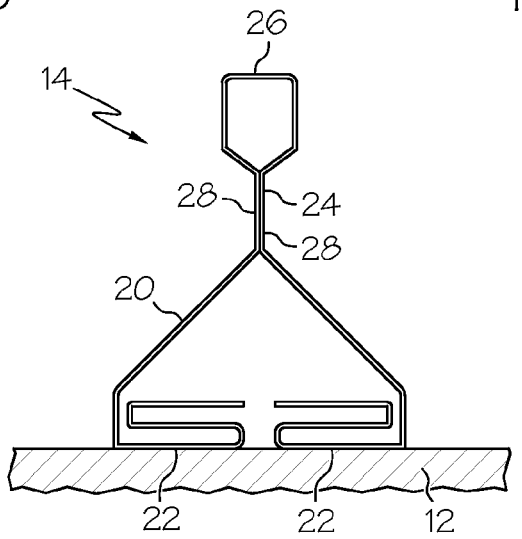
FIG. 5 is a cross-sectional view of another embodiment of a guide rail for an elevator system.
Figure 6:
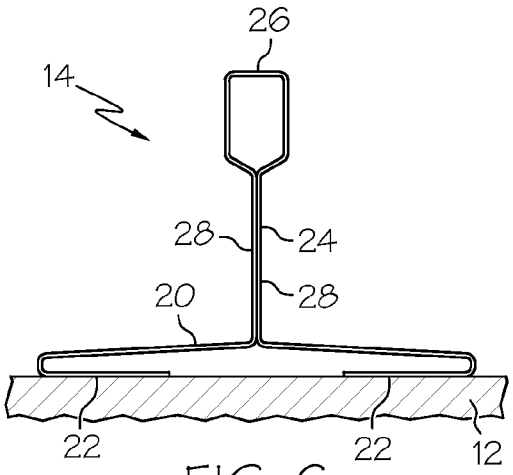
FIG. 6 is a cross-sectional view of a further embodiment of a guide rail for an elevator system.
Figure 7:
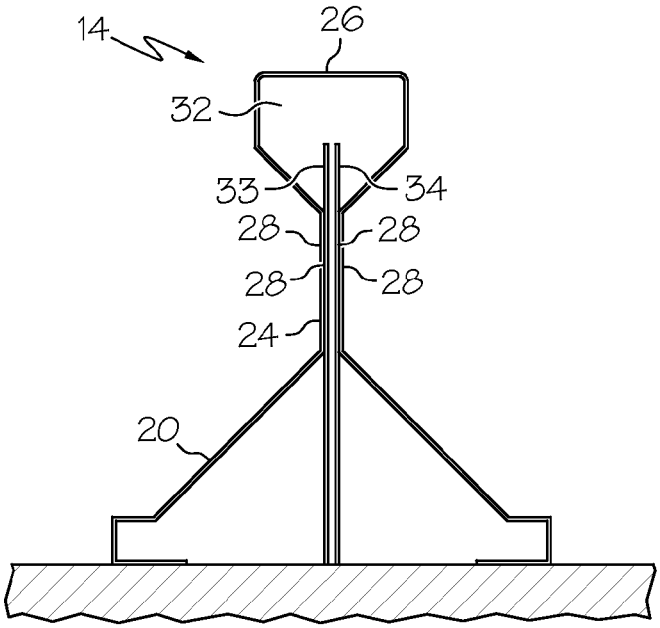
FIG. 7 is a cross-sectional view of yet another embodiment of a guide rail for an elevator system.
Figure 8:
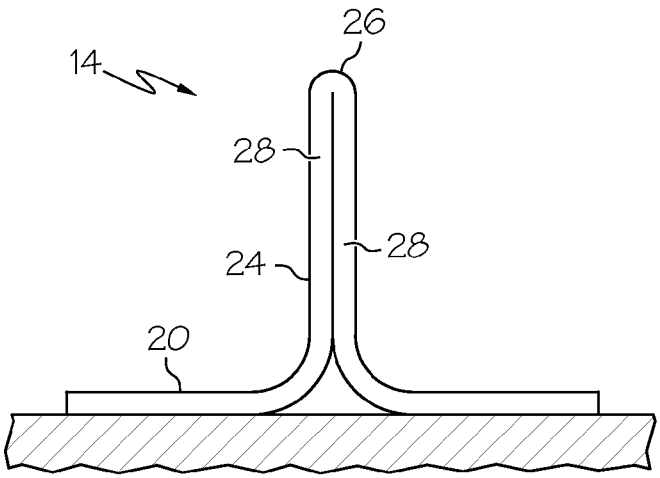
FIG. 8 is a cross-sectional view of still another embodiment of a guide rail for an elevator system.
Figure 9:
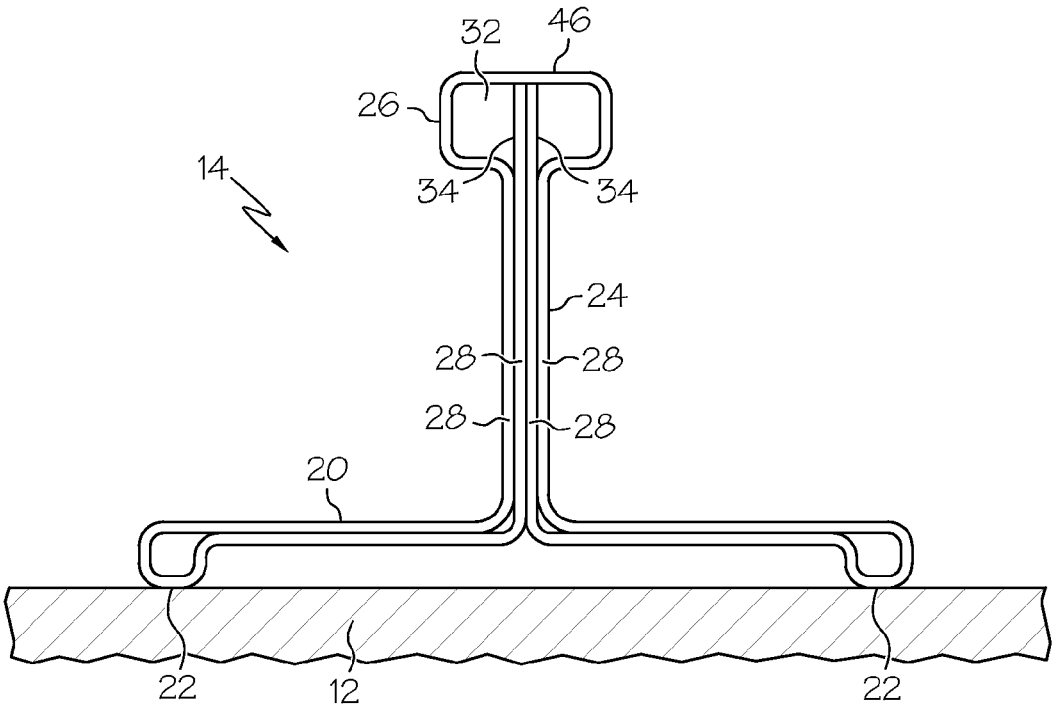
FIG. 9 is a cross-sectional view of another embodiment of a guide rail for an elevator system.

The embodiment of the guide rail 14 shown in FIG. 2 is merely exemplary, and other embodiments of guide rail 14 shape are shown in FIGS. 5-10. In FIG. 5, the guide rail 14 includes a triangular-shaped base 20 from which the web 24 extends to the tip section 26. The web 24 of the guide rail 14 comprises two material thicknesses 28, as opposed to the four material thicknesses of the embodiment shown in FIG. 2. The base includes a corrugated-shaped base pad 22 to interface with the wall of the hoistway 12. Referring now to FIG. 6, another embodiment includes a flat base 20 with a folded base pad 22. The web 24 of the guide rail 14 of FIG. 6 also comprises two material thicknesses 28. The embodiment of FIG. 7 includes a triangular base 20, and a web 24 which comprises four material thicknesses. The tip section 26 includes stiffeners 34 extending into the tip cavity 32. FIG. 8 shows is an embodiment in which the tip section 26 does not include a tip cavity 32, and the web 24 has two material thicknesses 28. Having the wall-thicknesses 28 side by side in the tip section 26 increases rigidity due to the lack of gap and will therefore withstand braking forces applied thereto. Shown in FIG. 9 is an embodiment having a base 20 with two base pads 22, one base pad 22 at each end of the base 20. The web 24 comprises four material thicknesses, and the tip section 26 includes two stiffeners 34 extending to a tip end 46 of the tip section 26.

Figure 10:
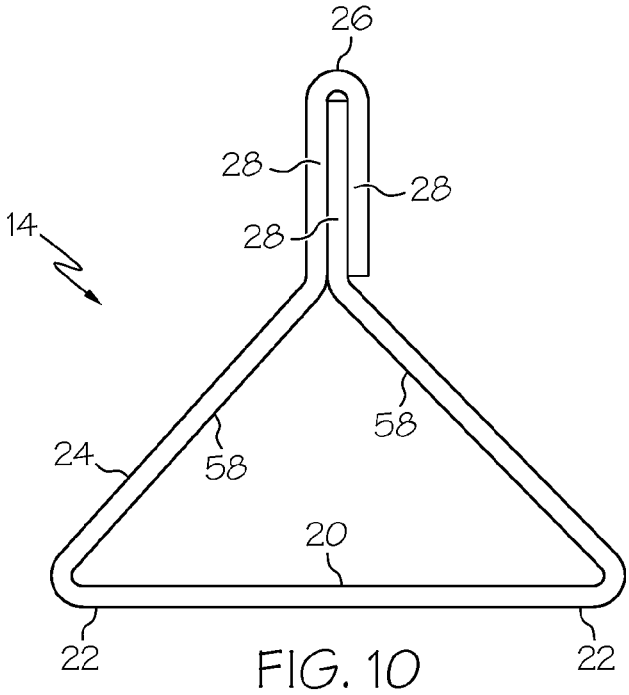
FIG. 10 is a cross-sectional view of yet another embodiment of a guide rail for an elevator system.

Another embodiment of a guide rail 14 formed from a single piece of sheet metal is shown in FIG. 10. The guide rail 14 includes a flat base 20 having two base pads 22 configured to rest against the wall of hoistway 12. The web 24 extends in one direction from the base 20 toward the elevator car 16. In this embodiment, the web 24 comprises two web legs 58 which define a triangular-shaped web 24. The tip section 26 comprises three material thicknesses 28 abutting one another with no gaps therebetween, effectively a solid form to withstand braking forces applied thereto.

Figure 11:
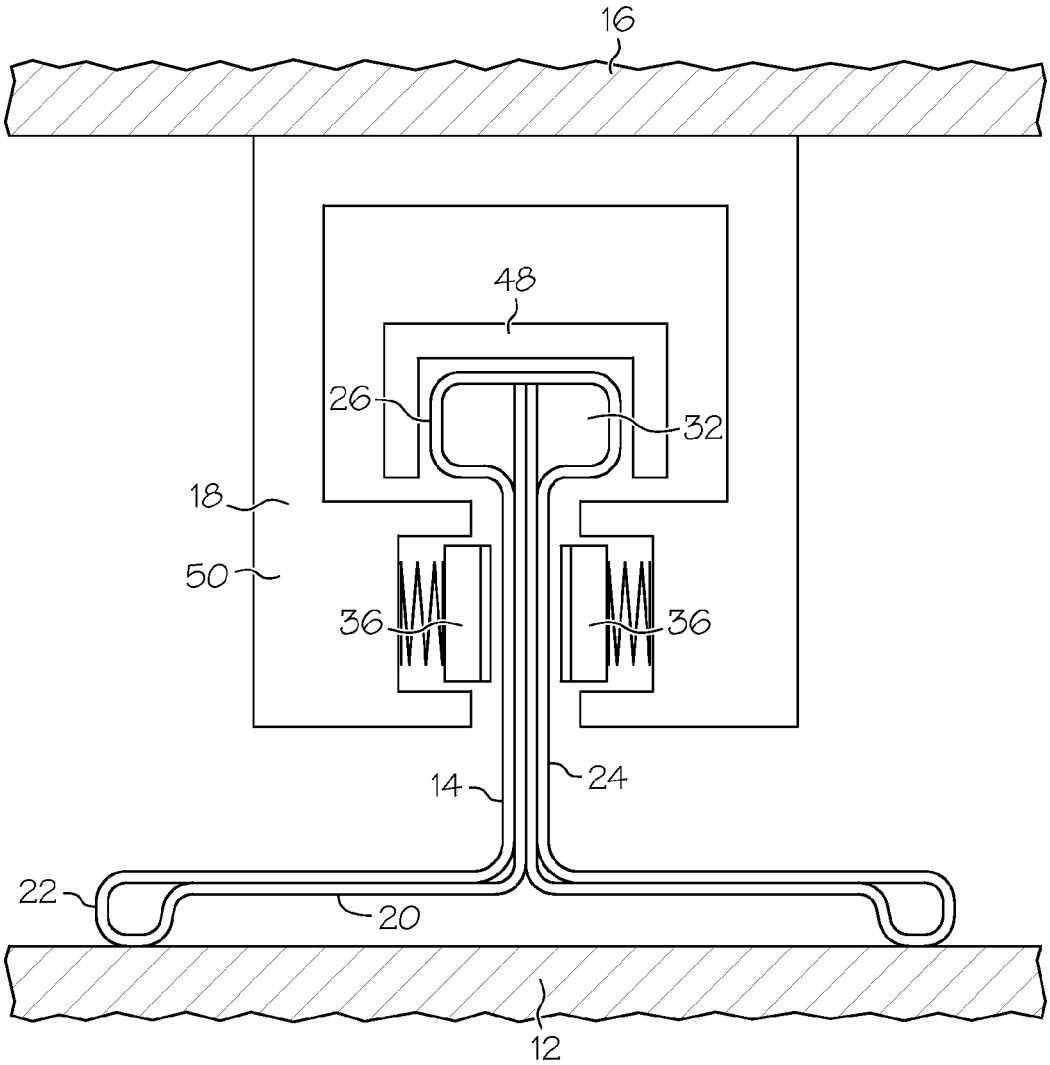
FIG. 11 is a cross-sectional view of an embodiment of a safety brake mechanism for an elevator system.

As shown in FIG. 11, some embodiments of guide rail 14 may be utilized with a safety brake 36 which engages the web 24 of the guide rail 14. The brake frame 48 is configured to engage the tip section 26 with a guide shoe 18. A braking portion 50 extends around the tip section 26 to the web 24, inboard of the tip section 26. When desired, the safety brake 36 is engaged and applies braking force to the web 24 to stop the elevator car 16. Such a safety brake 36 configuration requires less reinforcement of the tip section 26 than that of a typical safety brake, in which the safety brake 36 engages the tip section 26. Further, the unique brake frame 48 configuration prevents removal of the brake frame 48 (and the elevator car 16) from the guide rail 14 in the event of seismic movement of the building, or similar circumstances. It is prevented because the clearance of the brake frame 48 to the web 24 is smaller than a width of the tip section 26.

Figure 12:
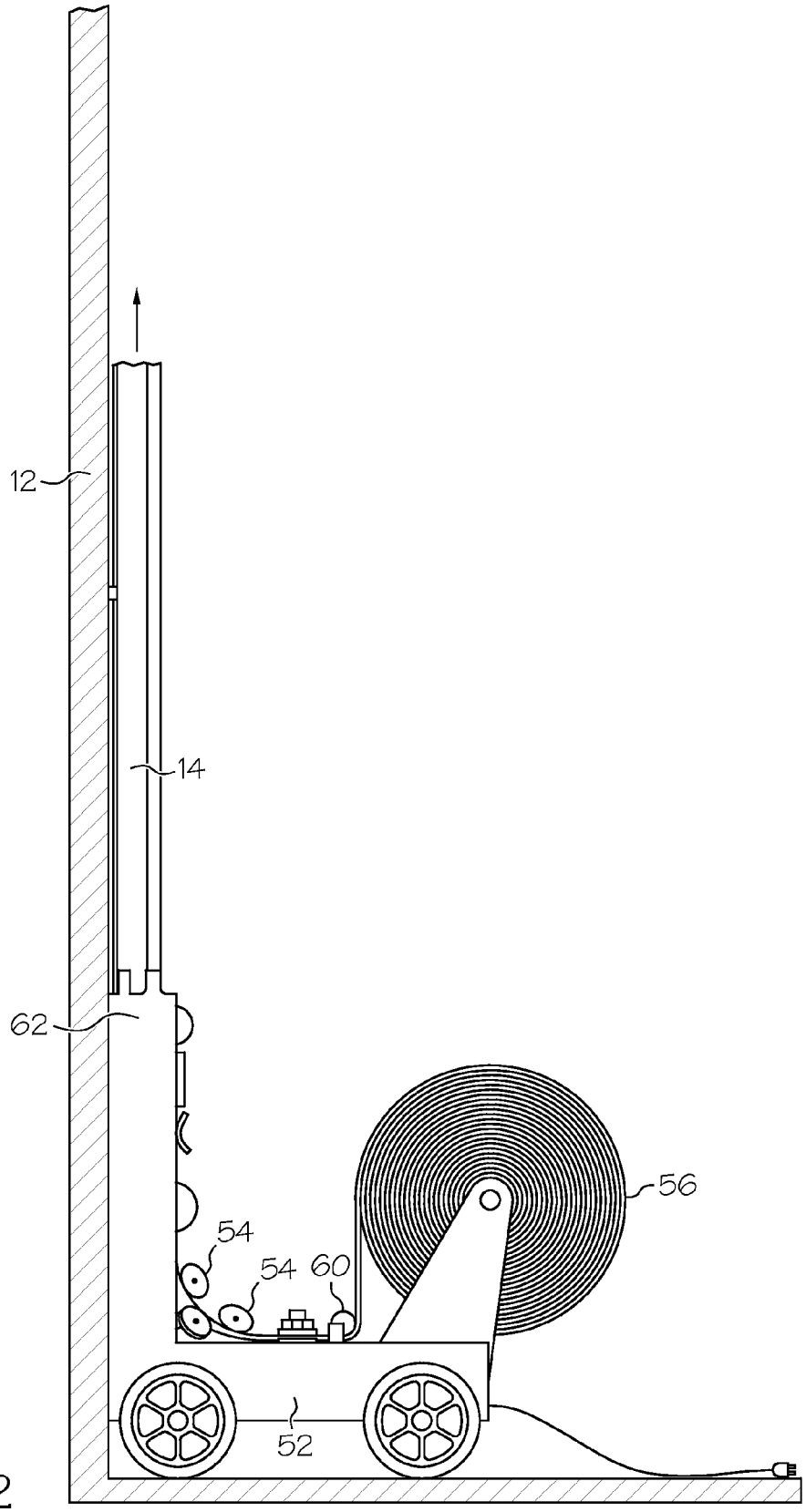
FIG. 12 is a schematic illustration of a method of forming a guide rail for an elevator system.

Forming the guide rail 14 from sheet metal allows for a lighter weight guide rail 14 when compared to a typical steel guide rail that has sufficient stiffness and rigidity. A lighter weight guide rail 14 makes for easier and safer installation of the guide rail 14 in the hoistway 12. Further, as shown in FIG. 12, the guide rail 14 may be formed onsite, even inside the hoistway 12. In one embodiment, a forming machine 52 including rollers 54, welders (not shown) and other components necessary to form the guide rail 14 from a flat piece of sheet metal, is located in the hoistway 12. A sheet metal stock 56 is fed into a first end 60 of the forming machine 52, and is rolled, formed, punched, and/or welded into a guide rail 14 having a desired cross section. The finished guide rail 14 exits a second end 62 of the forming machine 52 and, in some embodiments, may be positioned in the hoistway 12 and/or secured thereto by the forming machine 52. In some embodiments, the forming machine 52 may be configured to travel along the hoistway 12 as the guide rail 14 is formed. For example, the forming machine 14 may form a desired length of guide rail 14 which is positioned in the hoistway 12 and secured thereto. The forming machine 52 then is urged along the length of rail 14 via internal or external means, and forms a second length of guide rail 14. This process can be continued until the entire guide rail 14 is completed. Utilizing on-site forming of the guide rail 14 allows for simplified installation process, and in some cases, a single unitary guide rail 14 extending the entire length of the hoistway 12 can be formed. Such a guide rail 14 having no seams between discrete guide rail 14 segments eliminates mismatches that occur between segments and results in smoother and quieter operation of the elevator system 10.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. A guide rail for an elevator system in a hoistway, comprising:

a base connectable with a wall of the hoistway;

a web section connected to and extending from the base, the web section having a web cross-sectional width; and a tip section disposed at an end of the web section and operably connectable to an elevator car of the elevator system, the tip section having a tip cross-sectional width greater than the web cross-sectional width;

wherein the base, the web section and the tip section are formed of one or more thicknesses of sheet metal material and configured such that braking forces applied to the guide rail by a braking mechanism reduce the speed of the elevator car without resulting in failure of the guide rail;

wherein the tip section includes a tip cavity disposed therein; and wherein the tip section includes a stiffener disposed in the tip cavity extending along an entire length of the guide rail to reinforce and provide rigidity to the tip section.

2. The guide rail of claim 1 wherein the guide rail is formed in the hoistway from a sheet metal stock.

3. The guide rail of claim 2 wherein the guide rail is formed in the hoistway by a process including one or more of rolling, punching and/or welding.

4. The guide rail of claim 1 wherein the stiffener includes one or more closed loops of sheet metal material disposed in the tip cavity.

5. The guide rail of claim 1 wherein guide rail is formed from a single piece of sheet metal.

6. The guide rail of claim 1 wherein the web section comprises more than two thicknesses of sheet metal.

7. The guide rail of claim 1 wherein the braking forces are applied to the guide rail at the tip section.

8. The guide rail of claim 1 wherein the braking forces are applied to the guide rail at the web section.

9. An elevator system comprising:

an elevator car disposed in a hoistway;

a guide rail extending along the hoistway and operably connected to the elevator car for guiding the elevator car along the hoistway, the guide rail including:

a base connectable with a wall of the hoistway;

a web section connected to and extending from the base, the web section having a web cross-sectional width; and a tip section disposed at an end of the web section and operably connected to the elevator car, the tip section having a tip cross-sectional width greater than the web cross-sectional width;

wherein the base, the web section and the tip section are formed of one or more thicknesses of sheet metal material;

wherein the tip section includes a tip cavity disposed therein; and wherein the tip section includes a stiffener disposed in the tip cavity extending along an entire length of the guide rail to reinforce and provide rigidity to the tip section; and a braking mechanism operably connected to the guide rail and the elevator car, the guide rail configured such that braking forces applied by the braking mechanism to the guide rail reduce a speed of the elevator car without resulting in failure of the guide rail.

10. The elevator system of claim 9 wherein the guide rail is formed from a single piece of sheet metal.

11. The elevator system of claim 10 wherein the web section comprises more than two thicknesses of sheet metal.

12. The elevator system of claim 9 wherein the stiffener includes one or more closed loops of sheet metal material disposed in the tip cavity.

13. The elevator system of claim 9 wherein the braking mechanism applies a frictional force to the tip section of the guide rail when desired to reduce the speed of the elevator car along the hoistway.

14. The elevator system of claim 9 wherein the brake mechanism applies a frictional force to the web section of the guide rail when desired to reduce the speed of the elevator car along the hoistway.

15. The elevator system of claim 9 wherein the guide rail extends substantially seamlessly along an entire length of the hoistway.

16. The elevator system of claim 9 wherein the guide rail is formed in the hoistway from a sheet metal stock.

17. The elevator system of claim 16 wherein the guide rail is formed in the hoistway by a process including one or more of rolling, punching and/or welding.

18. The guide rail of claim 1, wherein the base, the web section, the tip section and the stiffener are formed from the same single continuous piece of sheet metal material.

* * * * *